United States Patent [19]

Boissoneault

[11] Patent Number: 4,800,934

[45] Date of Patent: Jan. 31, 1989

[54] DEVICE FOR POURING DRINKS HAVING LAYERS OF DIFFERENT DENSITIES

[76] Inventor: Mark Boissoneault, 202 Bernadine Crescent, Winnipeg, Manitoba, Canada, R2Y 1W4

[21] Appl. No.: 142,704

[22] Filed: Jan. 11, 1988

[51] Int. Cl.[4] ..... B67C 11/00

[52] U.S. Cl. ..... 141/106; 141/333; 141/339; 141/364

[58] Field of Search ..... 141/100, 106, 237, 331, 141/333, 334, 339, 364

[56] References Cited

U.S. PATENT DOCUMENTS

| | | | |
|---|---|---|---|
| 530,228 | 12/1894 | Keiner | 141/292 |
| 633,628 | 9/1899 | Vacher | 141/199 |
| 654,879 | 7/1900 | Dineen | 141/100 |
| 1,745,011 | 12/1927 | Frejacques | 141/296 |
| 2,189,967 | 2/1940 | Sprouse | 141/334 |
| 2,753,090 | 7/1956 | Fay | 222/479 |
| 3,139,224 | 6/1964 | Bloom | 222/478 |
| 3,185,189 | 5/1965 | Reid | 141/100 |
| 3,256,916 | 6/1966 | Silletti | 141/286 |
| 3,323,693 | 6/1967 | Miller | 222/479 |
| 3,566,929 | 3/1971 | Mead | 141/237 |
| 3,938,563 | 2/1976 | Gall | 141/298 |
| 3,966,099 | 6/1976 | Sanford, Jr. et al. | 222/478 |
| 4,126,164 | 11/1978 | Magnifico | 141/286 |
| 4,337,806 | 7/1982 | Cirella | 141/100 |
| 4,469,151 | 9/1984 | Wilson et al. | 141/286 |
| 4,611,641 | 9/1986 | Carter, Sr. | 141/100 |

FOREIGN PATENT DOCUMENTS 883152 10/1971 Canada .

*Primary Examiner*—Timothy F. Simone
*Assistant Examiner*—Joseph S. Machuga
*Attorney, Agent, or Firm*—Adrian D. Battison; Stanley G. Ade; Murray E. Thrift

[57] ABSTRACT

A device for pouring layered drinks comprises a base portion in the form of a tray defining four recesses onto which four separate glasses can be located. A top portion has four cup member recessed in an upper surface. Each cup member has four ribs extending radially outwardly therefrom so the ribs sit on the rim of the glass and hold the cup member projecting into the interior of the glass. A locating projection on one of the ribs cooperates with the side wall of the cup member to confine one portion of the rim of the glass into a required location. The base of the cup member is inclined downwardly toward the location projection and accordingly toward the one portion of the rim. An orifice of a specific size is formed in the base adjacent the location projection to allow the liquid to run from the orifice to the located portion of the rim of the glass to control liquid flow so that it forms a layer on liquid previously poured into the glass. The device thus accommodates manufacturing tolerances in the glass sizes.

19 Claims, 2 Drawing Sheets

DEVICE FOR POURING DRINKS HAVING LAYERS OF DIFFERENT DENSITIES

BACKGROUND OF THE INVENTION

Popularity has increased in recent years for alcoholic drinks which for aesthetic reasons are poured in a number of coloured layers with the layers being in varying densities from the highest density at the bottom the glass to the lowest density liquid at the top of the glass. Drinks of this type are well known as "Shooters" and while they have been known for many years have become increasingly popular both being consumed in bars and while entertaining in the home.

The general technique for pouring shooters involves the delicate pouring of a quantity of the liquid onto the back of a spoon which is placed within the glass closely adjacent the bottom or adjacent the surface of the previous layer with the liquid running from the spoon onto the side of the glass so that it can enter the glass without disturbing the previously poured layer. This technique is of course highly unscientific and unless carried out carefully the effect of the different layers can easily be lost particularly when the densities of adjacent layers are relatively close.

In the situation of a commercial bar it is of course desirable to enable drinks of this type to be poured rapidly in order to improve staff efficiency. In the home entertaining situation, the speed of pouring is generally a less important factor but certainly it is desirable to provide a device which can enable pouring of these drinks effectively by persons unskilled in the art. In addition the novelty effect obtained by providing a device for carrying out the pouring increases the entertainment value of the drinks themselves.

A number of previous devices have been proposed for assisting in the pouring of layered drinks of this type and a search has revealed U.S. Pat. Nos. 654,879 (Dineen), 3,185,189 (Reid), 3,256,916 (Silletti) and 4,126,164 (Magnifico). The devices to Silletti and Dineen are both of limited value since they require careful hand control of the device which is little more effective than the conventional spoon. The device of Reid is similarly little more than the conventional spoon but provides a mounting arrangement in which the spoon is held within the glass. The Magnifico device is of a more recent nature and provides an arrangement which in theory could effectively control the flow of liquid. However the device requires that an air tight seal is formed between the device and the top of a glass. In practice, however, the manufacture of glasses is a very imprecise art and measurement of the glasses even supplied from a particular batch will show that there are wide variations in size and significant eccentricity. The practical opportunity therefore of obtaining the necessary airtight seal is very limited except possibly in relation to specially manufactured glasses, thus limiting the device to the use of high priced glassware as opposed to readily available products.

SUMMARY OF THE INVENTION

It is one object of the present invention, therefore, to provide an improved dispensing device of this general type which can accommodate imperfections in the sizes of the glasses used.

It is a further object of the present invention to provide a device which is particularly attractive and presentable for sale as a home use device in which the social and entertainment value of the device is particularly enhanced.

According to the first aspect of the invention there is provided a device for use with a drinking glass in preparing a drink having layers of liquid of differing densities, the device comprising a support member having support surface means arranged to engage a rim of the glass such that the support member can rest upon the rim, a cup member carried on said support member and projecting therefrom downwardly relative to said support surface means to project into an interior of the glass, said cup member having an open top into which a liquid can be poured, a generally closed base onto which said poured liquid collects and orifice means in said cup member through which said liquid can flow arranged at a lower most position of the base to cause the cup member to empty through said orifice means, said orifice means being confined to one angular location around a periphery of the cup member, said support member including locating means projecting therefrom downwardly relative to said support surface means at a position to engage an outer surface of the glass to relatively move the glass and the support member to a position in which the closest point of approach of the cup member to the glass is constituted by said one angular location thereof.

According to a second aspect of the invention there is provided a device for use with a plurality of drinking glasses in preparing a drink having layers of liquid of differing densities, the device comprising a base member defining a plurality of recesses each arranged to receive and locate a base of a respective one of the glasses in upstanding relation from the base member, and a top portion integrally molded from a plastics material and including a support member having a plurality of support surface means each arranged to engage a rim of a respective one of the glasses such that the support member can rest upon the rims of the glasses as a substantially horizontal structure parallel to and spaced from the base member, a plurality of cup members on said support member each projecting therefrom downwardly relative to said support surface means to project into the interior of a respective one of the glasses, each cup member having an open top into which a liquid can be poured and generally closed base onto which said poured liquid collects and orifice means in said cup member through which said liquid can flow, the orifice means being arranged to dispense the liquid onto the inner surface of a respective one of the glasses.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

FIG. 1 is an isometric view of a device according to the invention with the glasses omitted for convenience of illustration.

FIG. 2 is a side view of the device of FIG. 1 including 2 glasses and taken partly as a side elevational view and partly as a cross sectional view.

FIG. 3 is a cross sectional view along the lines 3—3 of FIG. 2.

FIG. 4 is a cross sectional view along the lines 4—4 of FIG. 2.

DESCRIPTION OF THE DRAWINGS

In the drawings like characters of reference indicate corresponding parts in the different figures.

The device according to the present invention includes a base portion 10 and a top portion 11 which are separate and each is integrally molded from a suitable food grade plastics material preferably of a clear or smoked appearance so as to be attractive to the consumer. Plastics materials of this type are of course readily washable.

Figure 3:
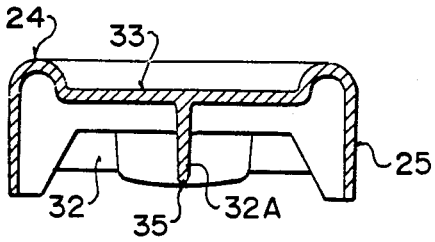
Figure 1:
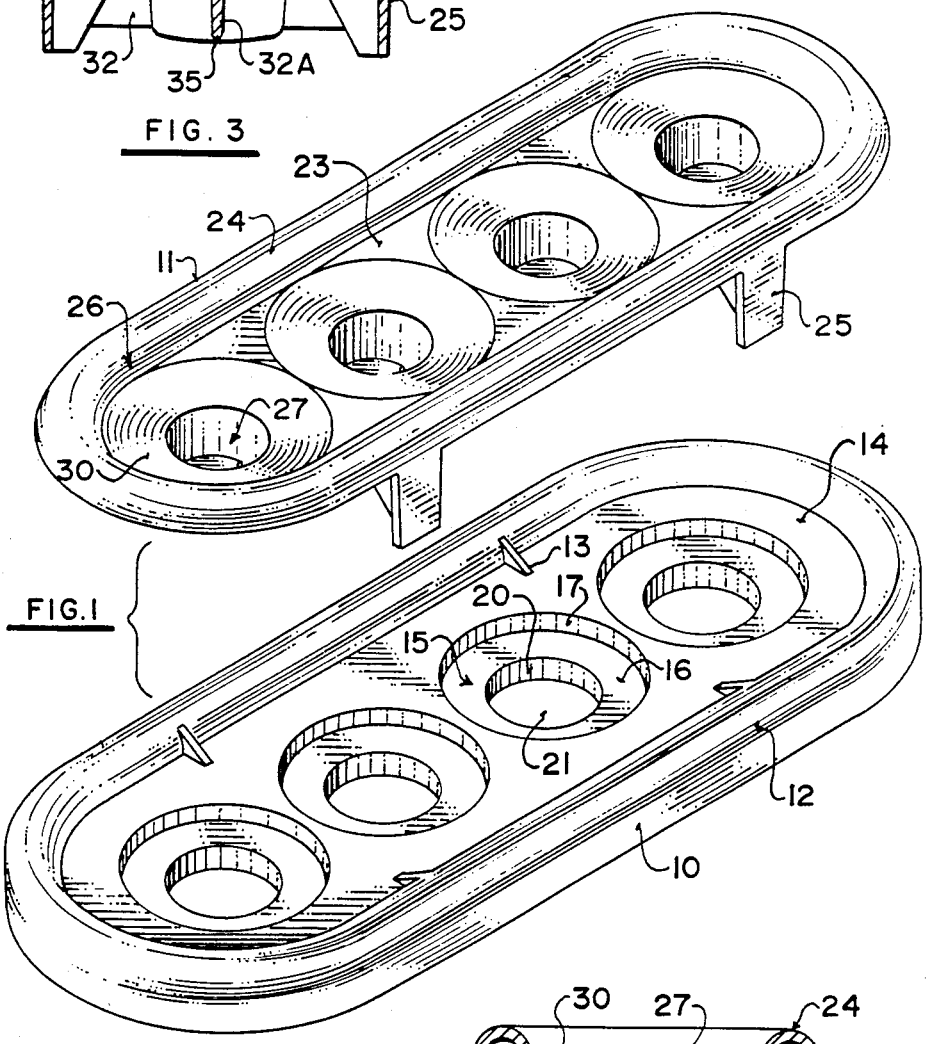

The base portion 10 effectively forms a tray with a surrounding convex rim 12 which is smoothly curved to provide an attractive appearance and includes the necessary ribs 13 for structural rigidity. A base of the tray is indicated at 14 and includes a plurality of recesses 15 of circular plan and each defining an annular recessed shelf 16. The outer periphery indicated at 17 is of a size just to receive a base 18 of a conventionally available liqueur glass indicated at 19. Within the inner periphery 20 of the shelf 16 is an opening 21 which includes a turned down lip 22 which will engage a support surface in the same horizontal plane as an outer edge of the curved rim 12.

The top portion 11 is of slightly smaller dimension than the base and is of similar appearance including a flat platform section 23 and a smoothly curved outer rim 24 which surrounds the platform 23. Four tabs 25 are formed at the lower outer most edge of the rim 24 so as to form downwardly projecting legs upon which the top can stand when separately supported on the horizontal surface.

Within the flat platform 23 is formed a plurality of recesses 26 each of which includes a cup member 27 of generally circular plan. The cup member has vertical or sharply inclined peripheral wall 28 and a substantially flat base 29 thus forming a substantially cylindrical receptacle into which a liquid can be poured. Between the cup member 27 and the platform surface 23 is a shallowly inclined annular surface 30 which ensures that liquid poured in the area of each of the cups runs into the respective cup for collection within the cup as shown at 31 in FIG. 2.

Figure 2:
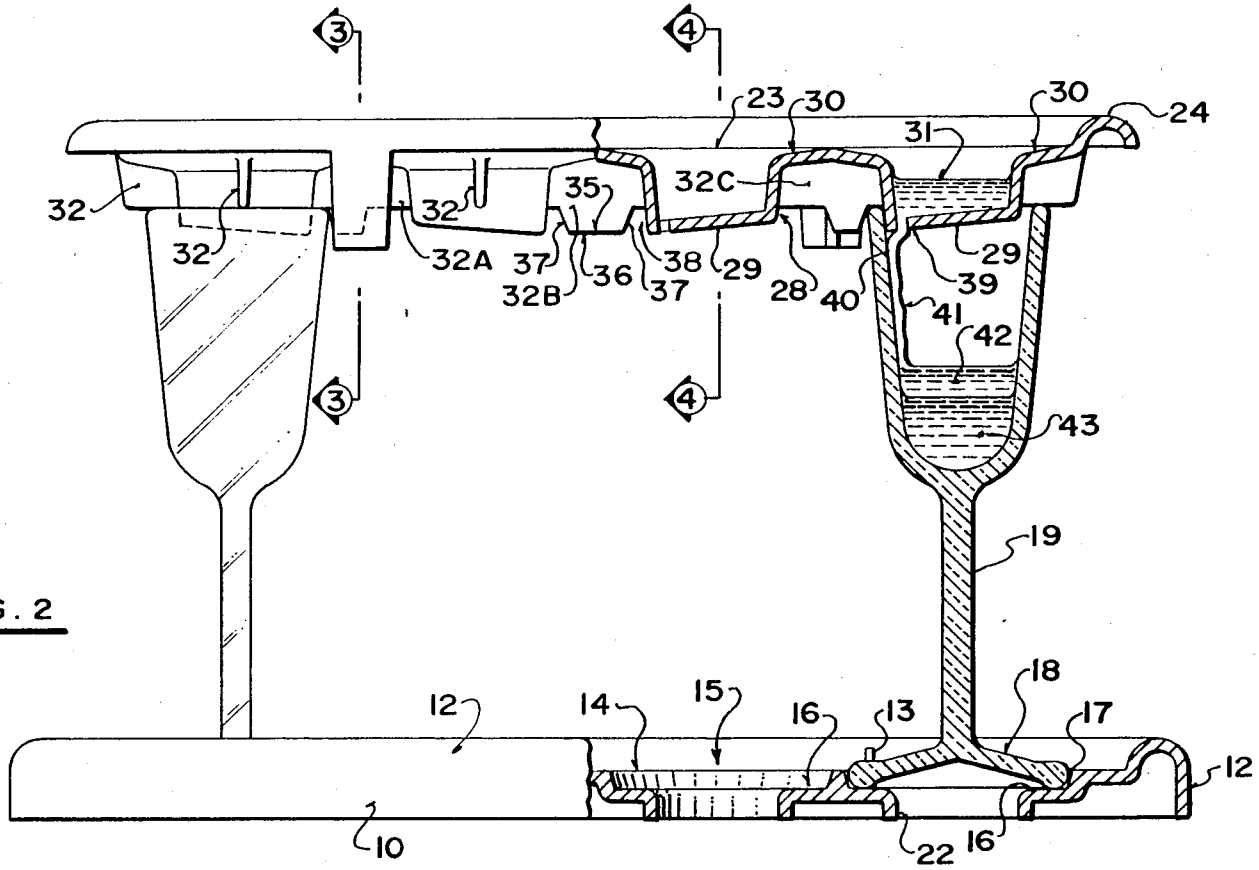

Each cup member has associated therewith four ribs 32 which project radially outwardly from the outer surface of the cup member at 90° spacing around the cup member. Each of the ribs 32 is contiguously formed with the outer surface of the inclined wall 28 of the cup member and also with the undersurface of the inclined wall 30 of the cup member. The side surface of the rib indicated at 33 terminates inside the outer most edge of the surrounding rib 24. The lower edge 34 of the rib terminates at a position above the base 29 of the respective cup member. There is thus defined a common horizontal plane surrounding the cup member by the lower surfaces 34 of each of the four ribs of the respective cup member. As shown in FIG. 2 the outer diameter of the peripheral wall of the cup member is less than the inner diameter of the glass with which the device is intended to operate so that each rib commences inside the glass and extends across the rim of the glass to a position outside of the glass so that the rim of the glass can readily support the four ribs to hold the top member 11 in a horizontal position spaced from the base member 10.

It will be noted that the ribs 32 are oriented angularly of the cup members so that each cup member has a pair of ribs extending along the longitudinal central plane of the top member. In between the cup members, therefore, the ribs are effectively contiguous so the rib of one cup member contiguously connects with the rib of the next cup member effectively to form a continuous rib therebetween. These continuous ribs are indicated at 32A, 32B and 32C respectively in FIG. 2. Each of the contiguous ribs includes a locating projection 35 which projects downwardly from the underside of the rib and includes a horizontal lower surface 36. Each side of the locating projection is inclined as indicated at 37 so as to form a Y shaped area generally indicated at 38 between the inclined surface 37 and the adjacent outer surface portion of the sharply inclined peripheral wall 28 of the respective cup member.

As best shown therefore in the right hand part of FIG. 2, the cup member is a loose fit within the rim of the glass 19 and thus basically the glass is free to move side to side across the surfaces 34 of the supporting ribs 32. However when the top portion is loosely placed upon the glasses resting upon the base portion, one portion of the rim of the glass enters the V shaped area 38 between the locating projecting 35 and the adjacent edge of the respective cup member. This V shaped area thus tends to locate the glass by moving it slightly to ensure that the edge of the cup member lies in contact with or very closely adjacent that one portion of the cup member wall.

In this regard it is been noted by careful experimentation by the present inventor that glasses of this type vary considerably in size and eccentricity and accordingly there is provided the present location projection which confines only a single part of the rim of the glass to a required position. It will be appreciated that the glass is a relatively loose fit both in the top portion 11 and the base portion 10 allowing various tolerances to take up any movement necessary to accommodate the differences in size of particular glasses.

Figure 4:
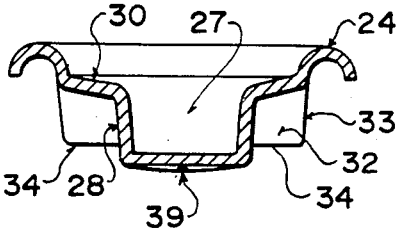

The base 29 of each of the cup members is effectively a flat surface but is inclined to a lower most position which is arranged to be directly at or closely adjacent to the respective location projection. An orifice 39 is provided in the base 29 at the lowest point of the base so as to allow the liquid 31 to escape from the cup member through the orifice 39. The orifice 39 as shown in FIG. 4 lies on the centre line of the top portion and thus lies immediately adjacent the rib 32 which also lies, as previously described on the centre line.

Thus the edge of the glass, the relevant part of which is indicated at 40 is located by the V shaped area 38 to lie immediately adjacent the opening or orifice 39. The orifice 39 is provided in the base so that there is no problem of the orifice being plugged by contact with the glass which could otherwise occur if the orifice were in the side wall of the cup member. The orifice lies immediately adjacent the side wall so that all liquid 31 can run down to the lower most part of the cup member and can escape through the orifice 39. The thickness of the wall 28 is chosen so that the orifice is closely adjacent the wall side of the glass. In this way liquid running from the orifice by the Corianda effect tends to cling to the underside of the cup member and run to the side of the glass as indicated at 41 to run down the side to form a layer of the liquid 42 which sits on top of a previous layer 43.

The size of the opening or orifice 39 is chosen to be specifically in the range 0.0055 to 0.0065 inches since careful experimentation has shown that an orifice of this size allows liquids of varying viscosities to pass through. Thus the most viscous liquid which is used in layered drinks of this type generally cannot pass through an orifice of this size but can be poured directly into the glass since its pouring does not require careful control. Liquids of a slightly less viscous nature can then be poured into the cup member for the controlled action of the orifice ensuring that the liquid runs onto the surface of the glass as previously described. At the same time the orifice is sufficiently small that it controls the lightest or least viscous liquids to prevent their pouring rapidly and uncontrolledly through the opening into the glass which would of course cause mixing of the liquids and a total destruction of the desired effect.

The design of the device incorporating a base and a top portion both of which are designed to receive a plurality of the glasses makes it particularly suitable for home entertainment use. An alternative arrangement (not shown) can include just a single part of the top portion with a single cup member surrounded by the ribs and locating projection as previously described together with inclined base and orifice which cooperate with the locating projection. In this case a base portion of the device is not necessary since location of the base of the glass is not necessary.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A device for use with a drinking glass in preparing a drink having layers of liquid of differing densities, the device comprising a support member having support surface means arranged to engage a rim of the glass such that the support member can rest upon the rim, a cup member carried on said support member and projecting therefrom downwardly relative to said support surface means to project into an interior of the glass, said cup member having an open top into which a liquid can be poured, a generally closed base onto which said poured liquid collects and orifice means in said cup member through which said liquid can flow arranged at a lower most position of the base to cause the cup member to empty through said orifice means, said orifice means being confined to one angular location around a periphery of the cup member, said support member including locating means projecting therefrom downwardly relative to said support surface means at a position to engage an outer surface of the glass to relatively move the glass and the support member to a position in which the closest point of approach of the cup member to the glass is constituted by said one angular location thereof.

2. The invention according to claim 1 wherein said support surface means defines a substantially horizontal plane allowing horizontal movement of said support member relative to said glass and wherein said locating means defines an inclined surface arranged to engage an outer portion of the rim of the glass to cause said relative movement.

3. The invention according to claim 2 wherein one surface of the cup member and said one surface of the locating means define a pair of converging sides acting to locate therebetween an edge of the glass, said one side of said cup member being arranged at said one angular location.

4. The invention according to claim 1 wherein the cup member is generally circular in plan and includes a flat base which is substantially circular in plan.

5. The invention according to claim 1 wherein the cup member includes a substantially flat base which is inclined toward said one angular location.

6. The invention according to claim 1 wherein said support surface means comprises a plurality of downwardly projecting ribs each rib being arranged to project substantially radially from an outer surface of said cup member.

7. The invention according to claim 6 wherein one of said ribs includes a downwardly projecting portion having an inclined side surface, said inclined side surface defining said locating means.

8. The invention according to claim 1 wherein said orifice means comprises a single hole extending through said cup member from an inside surface thereof to an outside surface thereof at an outer edge thereof, the hole being dimensioned such that it is sufficiently large to allow therethrough the passage of liqueurs of differing densities and sufficiently small so as to inhibit the flow of a liqueur of low density.

9. The invention according to claim 8 wherein the diameter of the hole lies in the range 0.055 to 0.065 inches.

10. The invention according to claim 1 wherein the support member includes a plurality of cup members and a plurality of support surface means, each of said plurality being arranged to cooperate with a respective one of a corresponding plurality of glasses.

11. The invention according to claim 10 wherein the device includes a base member separate from said support member and including a plurality of circular recesses each for receiving a base of a respective one of as plurality of glasses.

12. The invention according to claim 1 wherein said device comprises an integral molding forming said support member and said cup member.

13. A device for use with a plurality of drinking glasses in preparing a drink having layers of liquid of differing densities, the device comprising a base member integrally molded from a plastics material and defining an underside surface for resting upon a horizontal support and an upperside surface which is substantially horizontal and includes a plurality of recesses each arranged to receive and locate an underside of a base of a respective one of the glasses in upstanding relation from the base member, and a top portion integrally molded from a plastics material and including a support member having a plurality of cup members thereon each having a substantially flat closed base and a cylindrical wall surrounding said base with said wall projecting from said support member downwardly to project as a loose fit into the interior of a respective one of the glasses and a plurality of support surface means each arranged to extend outwardly from he cylindrical wall of a respective one of said cup members so as to engage a rim of a respective one of the glasses such that the support member can rest upon the rims of the glasses as a substantially horizontal structure parallel to and spaced from the base member each cup member having an open top into which a liquid can be poured onto said generally closed base on which said poured liquid collects and orifice means in said cup member through which said liquid can flow, the orifice means being arranged to dispense the liquid onto the inner surface of a respective one of the glasses.

14. The invention according to claim 13 wherein said orifice means is confined to one angular location around a periphery of the cup member, wherein said supporting member includes locating means projecting therefrom downwardly relative to said support surface means at a position to engage an outer surface of the glass to relatively move the glass and the support member to a position in which the closest point of approach of the cup member to the glass is constituted by said one angular location thereof.

15. The invention according to claim 14 wherein said support surface means defines a substantially horizontal plane allowing horizontal movement of said support member relative to said glass and wherein said locating means defines an inclined surface arranged to engage an outer portion of the rim of the glass to cause said relative movement.

16. The invention according to claim 15 wherein one surface of the cup member and said one surface of the locating means define a pair of converging sides acting to locate therebetween an edge of the glass, said one side of said cup member being arranged at said one angular location.

17. The invention according to claim 13 wherein the cup member is generally circular in plan said flat base is substantially circular in plan.

18. The invention according to claim 14 wherein said substantially flat base is inclined toward said one angular location.

19. The invention according to claim 13 wherein said support surface means comprises a plurality of downwardly projecting ribs each rib being arranged to project substantially radially outwardly from said cylindrical wall of said cup member.

* * * * *